US006276951B1

(12) United States Patent
Chen et al.

(10) Patent No.: US 6,276,951 B1
(45) Date of Patent: Aug. 21, 2001

(54) LATCHING DEVICE FOR A CARD EDGE CONNECTOR (2)

(75) Inventors: Li-Sen Chen, Kaohsiung; Ching-Huei Lin, Hsinchu; Chung-Hsin Huang, Chiayi; Hung-Kuang Yang, Miaoli; Chien-Yu Hsu, Nantou, all of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/442,664

(22) Filed: Nov. 18, 1999

(30) Foreign Application Priority Data

Apr. 23, 1999 (CN) ..... 88206385

(51) Int. Cl.[7] ..... H01R 13/62; H01R 13/627; H01R 13/648; H01R 4/66

(52) U.S. Cl. ..... 439/327; 439/359; 439/92

(58) Field of Search ..... 439/325, 326, 439/327, 328, 357, 358, 92

(56) References Cited

U.S. PATENT DOCUMENTS

| | | | | |
|---|---|---|---|---|
| 5,484,302 | | 1/1996 | Yamada et al. . | |
| 5,588,850 | * | 12/1996 | Pan et al. | 439/92 |
| 5,632,640 | | 5/1997 | Noda . | |
| 5,637,004 | * | 6/1997 | Chen et al. | 439/157 |
| 5,759,057 | * | 6/1998 | Cheng et al. | 439/328 |
| 6,024,592 | * | 2/2000 | Pai et al. | 439/326 |
| 6,027,357 | * | 2/2000 | Howell et al. | 439/326 |
| 6,042,411 | * | 3/2000 | Choy | 439/328 |

OTHER PUBLICATIONS

Republic of China Patent Application No. 84100813.
Republic of China Patent Application No. 86203326.

* cited by examiner

*Primary Examiner*—Paula Bradley
*Assistant Examiner*—Edwin A. León
(74) *Attorney, Agent, or Firm*—Kenyon & Kenyon

(57) ABSTRACT

A latching device used in a card edge connector for the installation of an auxiliary card such as a memory module card is disclosed. The card edge connector comprises a receptacle body and two latching devices located at two sides of the receptacle body. The latching device comprises: a movable part including an elongated flat plate having a fixed end and a free end, and a latching member located near to the flexible free end for detachably latching the auxiliary card to be inserted and rotated to its installation position; a fixed part comprising an elongated flat plate, an inserting portion extending from the flat plate for inserting into a mounting hole of the receptacle body, and an inserting/rotating stop extending from the flat plate for limiting depth with respect to the auxiliary card being inserted and angle with respect to the auxiliary card being rotated. By means of this invention, a latching device which is less liable to crack and can accurately latch the auxiliary card, as well as occupies a small space, is available.

4 Claims, 4 Drawing Sheets

LATCHING DEVICE FOR A CARD EDGE CONNECTOR (2)

BACKGROUND OF THE INVENTION

1. Field of the Invention

This invention relates to a card edge connector used for connecting an auxiliary card, such as a single-in-line memory (SIMM) module or a dual-in-line memory (DIMM) module, to a master board, such as a mother circuit board, and especially relates to a latching device for a card edge connector by which an auxiliary card can be obliquely inserted into a slot of the connector with its edge and than be rotated to a position parallel to the master board as well as be latched such that contacts located on the edge of the auxiliary card can electrically contact the terminals provided in the slot.

2. Description of the Prior Art

With the popularization of the notebook computer and the progress in manufacturing techniques, the shape or profile of memory is becoming smaller, for example, from a DIP profile to a CSP profile. Moreover, for the sake of convenience, it has become more popular to use a SIMM or DIMM card on which a plurality of memory chips are mounted, and a card edge connector for the installation of that card, to expand the capacity of memory. Many types of card edge connectors have been proposed in recent years. The proposed card edge generally comprises a receptacle housing and two latching arms located at and extended from opposing sides of the housing. There are many kinds of designs for the structure of the latching arm to overcome such problems as strength of the latching arms, convenience of operation, stability of latching, and space being occupied.

For example, it is disclosed in U.S. Pat. No. 5,484,302 a latching device provided with a first arm and a second arm in which the second arm includes a latching unit and a latching release unit. The first arm will be biased towards the second arm for fixing the latching device in a receptacle compartment of a connector when the latching device is inserted into the receptacle compartment. Moreover, a socket having a latching member is disclosed in R.O.C. Patent Application No. 84,100,813, in which a tongue is provided on and protruded from a bottom of a movable part of a latching arm, and a recess for receiving the tongue is provided on a fixed part thereof, such that a vertical motion of the movable part is avoided and motion in an inserting direction of an auxiliary board is limited. Such a patent is contemplated to overcome a drawback that a latching arm is difficult to latch up exactly to an auxiliary board when a SIMM card acting as the auxiliary board is inserted therein. Furthermore, an electrical connector for printed circuit board comprising a body portion and a latching member is disclosed in U.S. Pat. No. 5,632,640 (as well as Japanese Patent Application No. Hei-7-636). The latching member is provided with a round portion to match with the side edge of a circuit card and a pair of retaining arms extending above the round portion to engage another surface of the circuit card. In R.O.C. U.S. Patent Publication No. 313,334, a design utilizing two L-shape locating members to prevent a connector from dropping out a circuit board when it is turned around in a solder furnace is disclosed. The two locating members are respectively provided on a supporting wall and an insulating housing so that the connector can be rigidly mounted on the circuit board, and thereby can be kept in a position to be welded when it is transferred through a solder furnace, and will not slip off a mother board on which it is installed due to an operation on a module card to be inserted into the connector.

However, there are still many problems in such many proposed latching arms. For example, a latching arm tends to crack in unsuitable operation in the light of its tiny structure for the purpose of space saving or it is otherwise occupied spatially. Moreover, in terms of the latching accuracy, since the terminals mounted in the slot of the connector is very weak and thus could be damaged if the module card being inserted in the slot is over rotated. Even though the above mentioned R.O.C. Patent Application No. 84,100,813 has been directed towards and has attempted to solve such a problem, its structure is too complicated.

SUMMARY OF THE INVENTION

In view of the above problems, an object of this invention is to provide overall improvements for a latching device for a card edge connector which occupies small space, can accurately latch a card, is less liable to crack, and is easily manufactured.

Another object of this invention is to provide a latching device for an obliquely-inserted card edge connector which utilizes metallic material so as to reduce difficulty in manufacturing while sustaining its latching performance and strength.

A further object of this invention is to provide a latching device for an obliquely-inserted card edge connector which is stronger and can be made by metallic material integrally without too much difficulty.

To achieve the above objects, the latching device for a card edge connector according to this invention comprises a movable part and a fixed part, the movable part comprising an elongated flat plate having a fixed end and a flexible free end, and a latching member located near to the flexible free end for detachably latching the auxiliary card to be inserted and rotated to its installation position; the fixed part comprising an elongated flat plate, an inserting portion extending from the flat plate for inserting into a mounting hole of the receptacle body, and an inserting/rotating stop extending from the flat plate for limiting depth with respect to the auxiliary card being inserted and angle with the respect to the auxiliary card being rotated.

By means of the above structure, an auxiliary card can be latched by a most compact and stronger latching device for a card edge connector.

In accordance with the other concept of this invention, the fixed part further comprises a grounding pad for grounding the fixed part to and securing the fixed part on a master board. Moreover, the fixed part further comprises an abutting member for abutting against a lower surface of the inserted auxiliary card when it is in its installation position. Furthermore, the fixed part further comprises a flexing stop for limiting the angle with respect to the movable part being flexed.

By means of the abutting member, the angle with respect to the auxiliary card being rotated will be well limited. By means of the grounding pad, the card edge connector will be secured more firmly. By means of the flexing stop, the flexed angle with respect to the movable part being flexed will be limited and thus the movable part would be less liable to crack.

In one preferred embodiment of this invention, the movable part and the fixed part are made of metallic material integrally, the inserting portion of the fixed part is configured in a U-shaped section, and the upper end edge of the U-shaped section is provided with a biting tooth for firmly engaging the inserting portion with the receptacle body. Moreover, the movable portion is further provided with a releasing member near to its free end to be pushed to conveniently release the latching action of the movable part. Furthermore, the movable portion further comprises a curved portion consisted of a non-shifted portion, a stepping portion, and a shifted portion. Provision of the stepping portion improves the resilience of the movable portion.

In the other preferred embodiment of this invention, the movable part is made of plastic material and is formed integrally with the receptacle body, while the fixed part is made of metallic material. The working procedure of the metallic portion of the latching device in this case will be simplified. Moreover, the movable part is formed with two thickness via a step to increase its resilience and strength.

These and other objects, features and advantages of this invention will be apparent from the following more detailed description of the preferred embodiment of this invention as illustrated in the accompanying drawing.

DETAILED DESCRIPTION OF THE INVENTION

Figure 1:
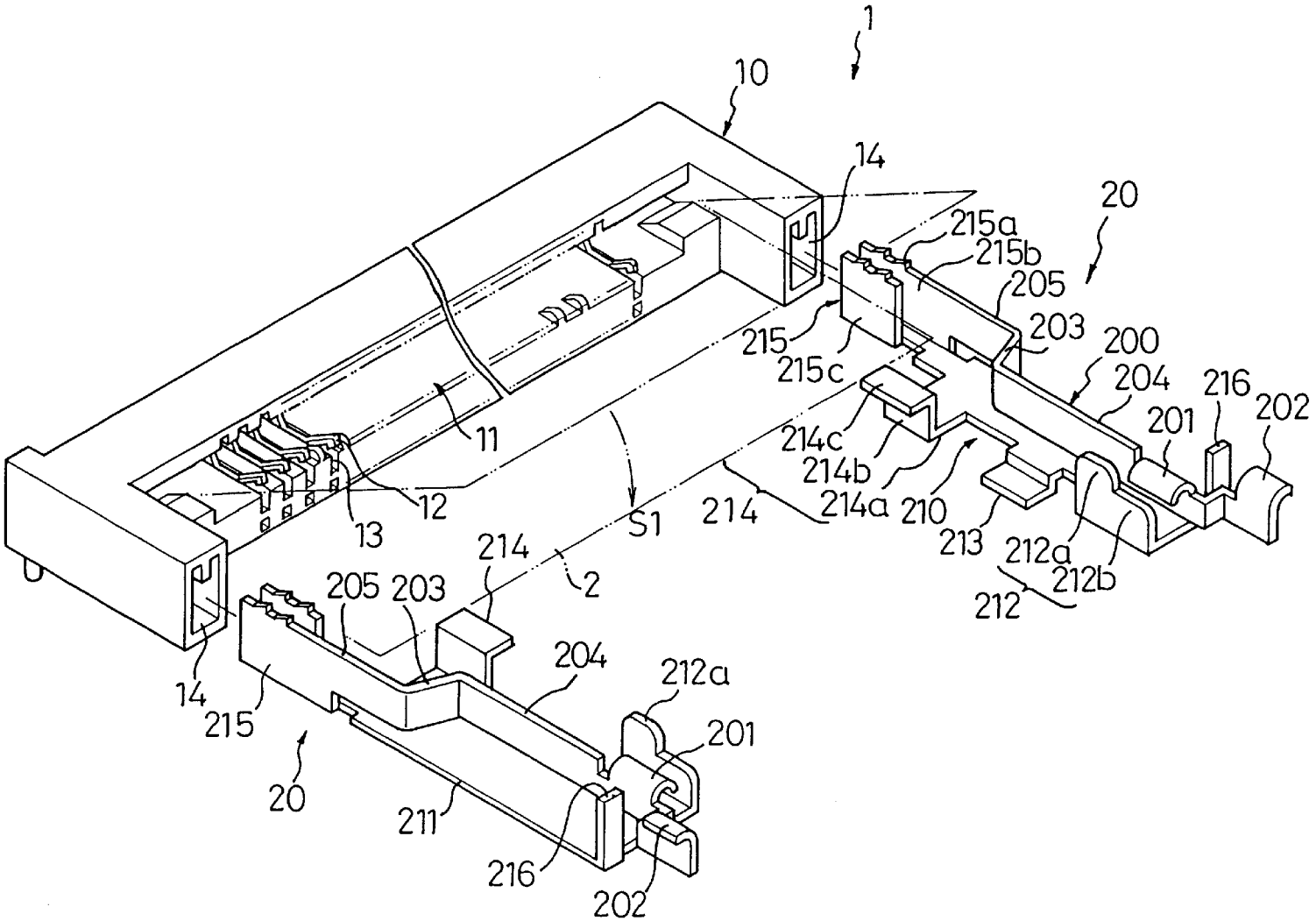
FIG. 1 is an exploded perspective view of a card edge connector consisted of a receptacle body and two latching devices according to the first embodiment of this invention.

As shown in FIG. 1, a card edge connector 1 in which a latching device according to this invention is applied comprises a plastic receptacle body 10 and two latching devices 20 respectively located at two sides of the receptacle body 10. The receptacle body 10 comprises a slot 11 provided on a card-inserting face thereof, a plurality of grooves 12 provided on two side walls defining the slot 11, a plurality of terminals 13 mounted in the plurality of grooves 12 respectively, and two mounting holes 14 located at two sides of the receptacle body 10 for respectively receiving a part of the latching device 20.

The slot 11 is used for receiving an edge of an auxiliary card 2. The grooves 12 are used to receive terminals 13. The terminals 13 can be any proper shape and can be mounted on the grooves 12 in one line or two lines such that the contacts provided on one or two surfaces near to the edge of the auxiliary card 2 can be contacted by the terminals 13 when the auxiliary card 2 is inserted into the slot 11 and rotated to an installation position S1 thereof. The mounting hole 14 is shaped in correspondence with the shape of the part of the latching device to be received so as to firmly secure the part of the latching device.

The latching device 20 is used for latching the auxiliary card 2 when it is rotated to its horizontal installation position S1 so as to prevent the auxiliary card 2 from dropping out of its installation position in which the terminals 13 are tightly contacted. As shown in FIG. 1, the latching device 20 according to the first preferred embodiment of this invention comprises a movable part 200 and a fixed part 210 which are integrally made of metallic material.

The movable part 200 comprises an elongated flat plate having a fixed end and a free end, a latching member 201 located near to the free end, a releasing member 202 located near to the free end, and a curved portion located between the fixed end and the free end. The so-called curved portion includes a non-shifted portion 205, a shifted portion 204, and a stepping portion 203 located between the non-shifted portion 205 and the shifted portion 204.

The fixed part 210 comprises an elongated flat plate 211, an inserting portion 215 extending from the flat plate, an abutting member 214 extending from one inner side edge of the flat plate 211, a grounding pad 213 extending from one inner side edge of the flat plate 211, an inserting/rotating stop 212 extending from one inner side edge of the flat plate 211, and a flexing stop 216 extending from an end edge of the flat plate 211.

The abutting member 214 is substantially located at a middle position of the elongated flat plate 211 and comprises a first wall 214*a* extending, in co-plane with the flat plate, from the inner side edge of the flat plate 211, a second wall 214*b* extending upward, vertical to the first wall 214*a*, from the end edge of the first wall 214*a*, and a third wall 214*c* extending outward, vertical to the second wall 214*b*, from the end edge of the second wall 214*b*. The third wall 214*c* has an upper surface which is substantially parallel to and can engage or abut against a lower surface of the auxiliary card 2 when it is rotated to its installation position S1. By means of such a structure, the middle portion of the auxiliary card 2 will be able to be supported so as to facilitate the latching effect resulted by the latching member 201 in cooperation with the inserting/rotating stop 212.

The grounding pad 213 can be welded onto a master board (not shown) so as to serve as a grounding and a connection of the connector 1 to the master board. By means of the grounding pad 213, the mounting of the connector 1 on the master board could be enhanced due to increment of its cover area for mounting.

The inserting/rotating stop 212 has an end edge which faces the lower surface of the auxiliary card 2 to be inserted and is configured in a step having an upper step 212*a* and a lower step 212*b*. The upper step 212*a* has an end edge at a length suitable to pass through a positioning hole (not shown) provided on the auxiliary card 2. The depth with respect to the auxiliary card 2 being inserted into the slot 11 of the receptacle body 10 can be limited by means of head edges of the upper step 212*a*. That is, the upper step 212*a* is used as an inserting stop. Corner formed by the end edge and the head edge of the upper step 212*a* is preferred to be rounded so as to facilitate the insertion of the upper step 212*a* into the positioning hole. The lower step 212*b* has an end edge being extended such that its end edge can abut against a lower surface of the auxiliary card 2 when it is rotated to its installation position S1, and thus is used as a rotating stop.

The flexing stop 216 is in the form of a post and has a side edge substantially parallel to an outer side surface of the shifted portion 204 of the movable part 200 so as to limit the angle with respect to the free end of the movable part 200 being flexed outward.

The inserting portion 215 is configured in a U-shaped section extending upwards from two side edges of the flat plate 211 and thus has two walls 215*b* and 215*c*. The inserting portion 215 further has a lots of oblique biting teeth

215*a* located on the upper edge of the two walls 215*b* and 215*c* for firmly engaging with walls defining the mounting hole 14 as well as for shifting the inserting portion 215 downward when it is inserted thereinto so as to locate the fixed part 210 at a desired horizontal level in which an accurate mounting of the latching device 20 on the master board can be obtained.

The fixed end of the movable part 200 is integrally formed with the outer wall 215*b* of the inserting portion 215 and is thus extended from a side edge of the wall 215*b*. The latching member 201 is extended partly from the upper edge of the shifted portion 204 at a proper length configured in a self-circle having a recess opening downwards and an end edge facing downward. The latching member 201 is extended such that its end edge can abut against an upper surface of the auxiliary card 2 when it is rotated to its installation position S1. Thus, the auxiliary card 2 can be smoothly rotated into the installation position S1 via a round outer surface of the latching member 201 and will be clipped between the end edge of the latching member 201 and that of the lower step 212*b* when it is in its installation position S1.

The releasing member 202 is located between the latching member 201 and the free end and is extended to assume an arc shape diverging outwards from the upper edge of the flat plate of the movable part 200 near to the free end thereof.

The stepping portion 203 is used to shift an extending surface of the shifted portion 204 from an extending surface of the non-shifted portion 205 towards the other latching device located at the other side of the connector 1 so as to increase the resilience of the movable part 200.

Figure 2:
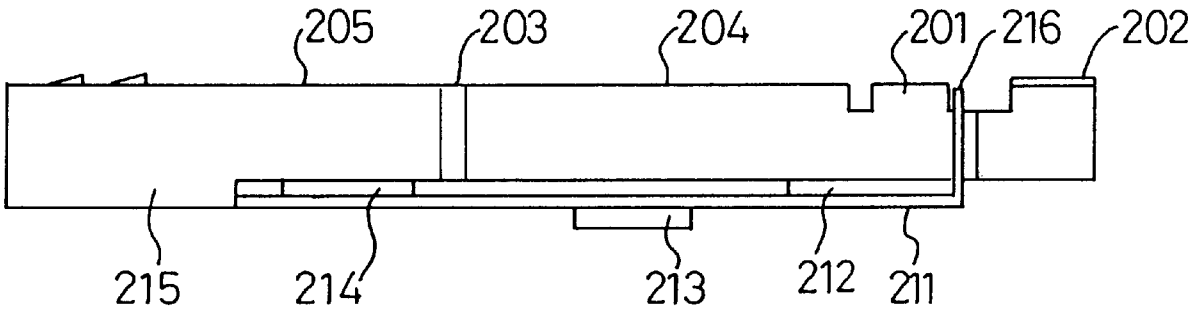
FIG. 2 is a side view of the latching device shown in FIG. 1 from the outside.
Figure 3:
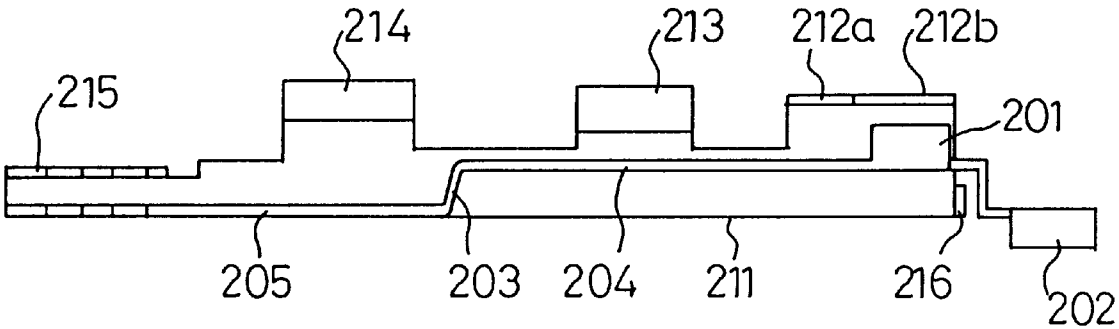
FIG. 3 is a top view of the latching device shown in FIG. 1.

FIGS. 2 and 3 respectively show an outside side view and a top view of the latching device 20 according to the above mentioned. As shown in FIG. 2, there is a gap between a bottom edge of the movable part 200 and an upper surface of the flat plate of the fixed part 210 and thus the movable part 200 can freely flex above the fixed part 210. Moreover, as shown in FIG. 3, it is clearer that the angle with respect to the movable part 200 being flexed outward will be restricted by the side edge of the flexing stop 216, while the angle with respect to the movable part 200 being flexed inwards can be restricted by an outer side surface of the inserting/rotating stop 212. Thus, a cracking situation of the movable part 200 will be reduced due to the provision of the stops 216 and 212.

Figure 4:
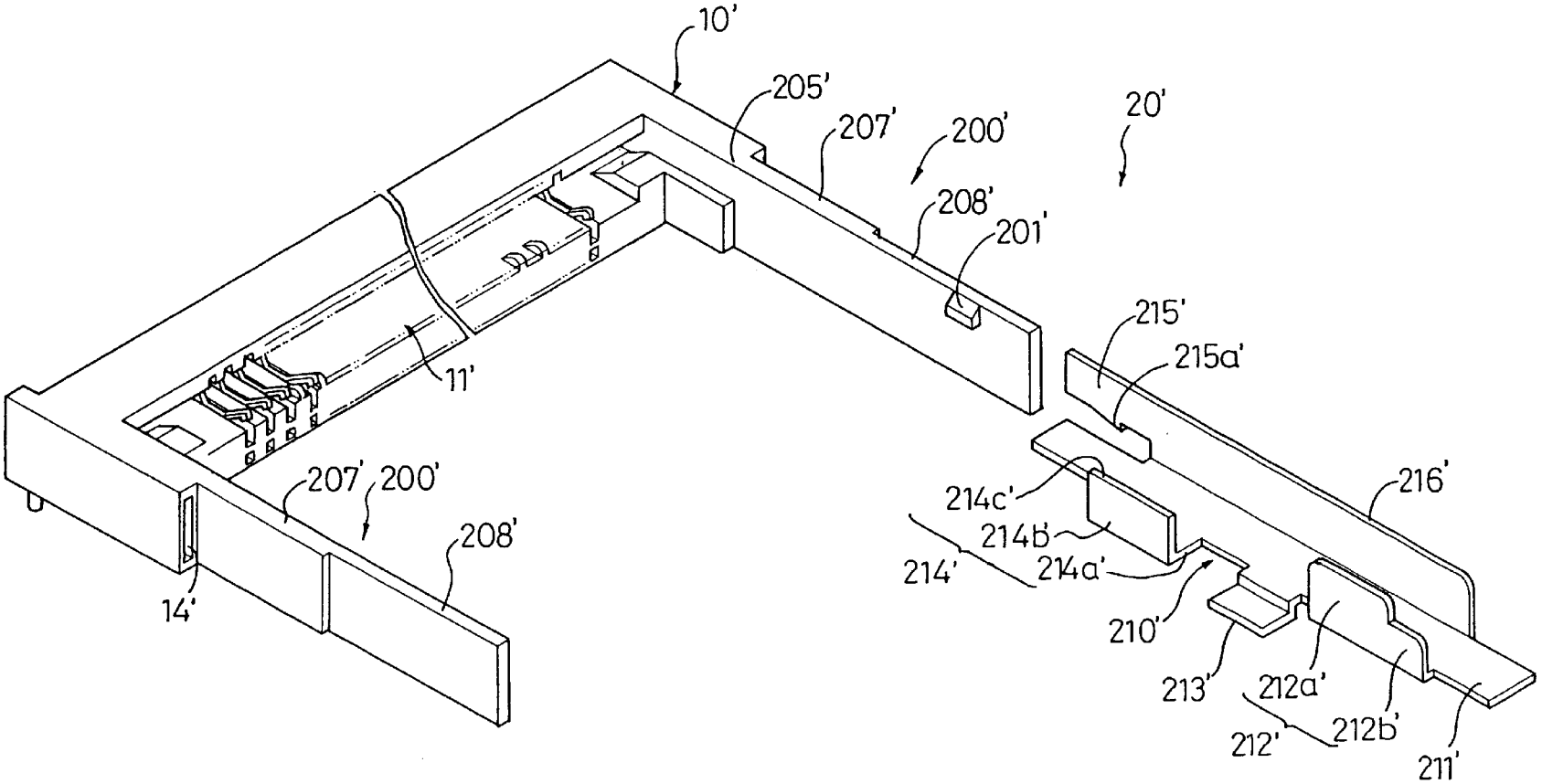
FIG. 4 is an exploded perspective view of a card edge connector consisted of a receptacle body and two latching devices according to the second embodiment of this invention, with only a latching device located on one side of the connector being shown.

FIG. 4 shows a card edge connector 1' in which a latching device 20' according to a second embodiment of this invention is applied. As shown in FIG. 4, the connector 1' also comprises a receptacle body 10' and two latching devices 20' respectively located at two sides of the receptacle body 10' (one of the latching devices on one side is omitted). Generally, the receptacle body 10' disclosed in this embodiment is substantially the same as that in the first embodiment and thus its detailed description is omitted herein. The difference between the two receptacle bodies disclosed in the two embodiments resides in the connecting structure between the latching device 20' and the receptacle body 10'. Briefly, a mounting hole 14' for insertion of a part of the latching device 20' is in a new configuration, and each side of the receptacle body 10' is integrally formed with a movable part 200' of the latching device 20'.

As shown in FIG. 4, the latching device 20' according to the second embodiment of this invention comprises a movable part 200' made of plastic material and a fixed part 210' made of metallic material. The movable part 200' comprises an elongated flat plate having a fixed end and a free end, a latching member 201' located on an inner surface of the flat plate near to the free end thereof. The fixed part 210' comprises an elongated flat plate 211', an inserting portion 215', an abutting member 214', a grounding pad 213', an inserting/rotating stop 212', and a flexing stop 216.

The structures of the grounding pad 213' and the inserting/rotating stop 212' are the same as those disclosed in the first embodiment of this invention and thus their descriptions are omitted herein. The abutting member 214' is substantially the same as that in the first embodiment except that the third wall 214*c* disclosed in the first embodiment is omitted. Thus, in this case, the second wall 214*b'* will be served to abut against an auxiliary card 2 (as shown in FIG. 1) with its end edge 214*c'* and thus is extended such that its end edge 214*c'* can abut against the lower surface of the auxiliary card 2 when it is rotated to its installation position S1. The flexing stop 216' is configured in a plate extending partly and vertically from an outer side edge of the flat plate 211' and has an inner side surface substantially parallel to an outer side surface of the movable part 200' so as to limit the angle with respect to the free end of the movable part 200' being flexed outwards. The inserting portion 215' is extended from one side edge of the flexing stop 216' near to the receptacle body 20' and thus can be deemed as being located at one end of the flexing stop 216' near to the receptacle body 20' and extended from the flat plate 211'. At a bottom edge of the inserting portion 215', an oblique tooth 215*a'* is provided for biting a side wall defining the mounting hole 14' when the inserting portion 215' is inserted into the mounting hole 14'.

The fixed end of the movable part 200' is integrally formed with the receptacle body 20'. The movable part 200' consists of a thicker first arm portion 207' and a thinner second arm portion 208' and has a co-planar inner surface thereby featuring the movable part 200' with better resilience and greater strength. The latching member 201' is integrally formed on an inner side surface of the thinner second arm portion 208' and has an oblique upper surface and a substantially horizontal lower surface being located such that an upper surface of the auxiliary card 2 will be abutted thereby when it is rotated to its installation position. Moreover, it can be contemplated in this embodiment that an end portion of the movable part near to the free end could serve as a place to be pushed so as to release the latching action of the latching member 201'.

Figure 5:
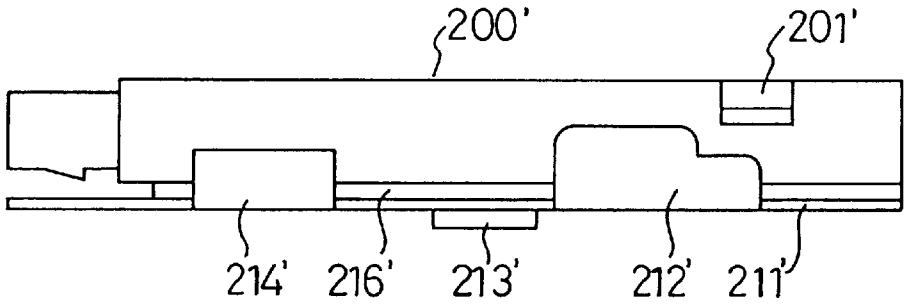
FIG. 5 is a side view of the latching device shown in FIG. 4 from the inside.
Figure 6:
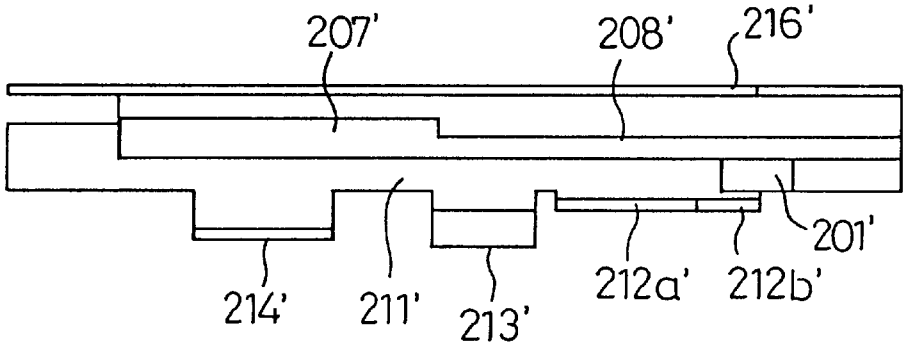
FIG. 6 is a top view of the latching device shown in FIG. 4.

FIGS. 5 and 6 show an inside side view and a top view of the latching device 20' shown in FIG. 4, respectively. As mentioned in the above first embodiment, the movable part 200' can freely flex outwards and inwards above the flat plate 211' and will be limited by the flexing stop 216' and the inserting/rotating stop 212' provided on the fixed part 210'.

By means of the latching device 20' disclosed in the second embodiment of this invention, the working of the fixed part 210' which is made of metallic material will be simplified while the strength of the latching device is sustained.

In view of the above structure disclosed in the embodiments of this invention, an auxiliary card would be able to be installed and latched on the card edge connector 1 by a compact, stronger, and resilient latching device. Moreover, it should be understand that the abutting member 214, 214', the grounding pad 213, 213', and the flexing stop 216,216' of the fixed part 210, 210', and the releasing member 202 of the movable part 200 would be optional and should not affect the latching effect which serves as a basic requirement for the latching device. Therefore, the basic concept of this invention can be directed by the provision of the special structure of the latching device which has a movable part and a fixed part and has an inserting/rotating stop provided on the fixed part as well as a latching member provided on the movable part.

However, while the preferred embodiment of the latching device disclosed by this invention have been illustrated and described, it should be understood that variations will be apparent to those skilled in the art. Accordingly, this invention is not to be limited to the specific embodiments illustrated and described, and the true scope and spirit of this invention are to be determined by reference to the following claims.

What is claimed is:

1. A latching device for a card edge connector, the connector comprising a plastic receptacle body and two latching devices, the receptacle body being provided with a slot for receiving an auxiliary card and two mounting holes located on two sides of the receptacle body for respectively receiving a part of the latching device, each of the two latching devices being extended in a direction vertical to a longitudinal direction of the receptacle body, and being characterized by comprising:

a movable part comprising an elongated flat plate having a fixed end and a free end, and a latching member located near to the free end for detachably latching the auxiliary card to be inserted and rotated to its installation position; and a fixed part comprising an elongated flat plate, an inserting portion extending from the flat plate for inserting into the mounting hole of the receptacle body, and an inserting/rotating stop extending from the flat plate for limiting depth with respect to the auxiliary card being inserted and angle with respect to the auxiliary card being rotated;

wherein the fixed part further comprises an abutting member for abutting against, along with the inserting/rotating stop, a lower surface of the auxiliary card when it is located in its installation position; and wherein the movable part and the fixed part are made of metallic material integrally, the inserting portion being configured in a U-shaped section extending from the flat plate, and the movable part being extended from one of the side walls of the U-shaped sectional inserting portion.

2. The latching device as claimed in claim 1, wherein the inserting portion comprises a biting tooth located on an upper edge thereof for firmly engaging with walls of the receptacle body defining the mounting hole.

3. The latching device as claimed in claim 1, wherein the movable part further comprises a releasing member located near to the free end thereof, which is provided with an arc portion extending from an upper side edge of the flat plate.

4. The latching device as claimed in claim 1, the movable part further comprises a curved portion consisted of a non-shifted portion extending from an outer wall of the U-shaped sectional inserting portion, a shifted portion on which the latching member is located, and a stepping portion located between the non-shifted portion and shifted portion by which the shifted portion is shifted toward the latching device located at an opposing side of the connector.

* * * * *

UNITED STATES PATENT AND TRADEMARK OFFICE

CERTIFICATE OF CORRECTION

PATENT NO. : 6,276,951 B1
DATED : August 21, 2001
INVENTOR(S) : Chen, Li-Sen et al.

It is certified that error appears in the above-identified patent and that said Letters Patent is hereby corrected as shown below:

Column 1,
Line 41, change “84,100,813” to -- 84100813 --
Line 57, delete “U.S.”

Column 2,
Line 10, change “84,100,813” to -- 84100813 --

Signed and Sealed this

Twenty-sixth Day of November, 2002

*Attest:*

*Attesting Officer*

JAMES E. ROGAN
*Director of the United States Patent and Trademark Office*